US010480295B2

(12) United States Patent
Walker et al.

(10) Patent No.: US 10,480,295 B2
(45) Date of Patent: Nov. 19, 2019

(54) JET PERFORATING DEVICE FOR CREATING A WIDE DIAMETER PERFORATION

(71) Applicant: Halliburton Energy Services, Inc., Houston, TX (US)

(72) Inventors: Jerry L. Walker, Azle, TX (US); Jason Paul Metzger, Joshua, TX (US); Gerald Graves Craddock, Jr., Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 322 days.

(21) Appl. No.: 14/778,513

(22) PCT Filed: May 30, 2013

(86) PCT No.: PCT/US2013/043491
§ 371 (c)(1),
(2) Date: Sep. 18, 2015

(87) PCT Pub. No.: WO2014/193397
PCT Pub. Date: Dec. 4, 2014

(65) Prior Publication Data

US 2016/0153267 A1 Jun. 2, 2016

(51) Int. Cl.

| | |
|---|---|
| ***E21B 43/114*** | (2006.01) |
| ***E21B 43/117*** | (2006.01) |
| *F42B 1/00* | (2006.01) |
| *F42B 1/024* | (2006.01) |
| *F42B 1/028* | (2006.01) |
| *F42B 1/032* | (2006.01) |
| *F42B 3/08* | (2006.01) |
| *E21B 29/00* | (2006.01) |
| *E21B 29/02* | (2006.01) |
| *E21B 43/11* | (2006.01) |

(52) U.S. Cl.
CPC ..... *E21B 43/114* (2013.01); *E21B 43/117* (2013.01)

(58) Field of Classification Search
CPC ..... F42B 12/00; F42B 12/14; F42B 1/024; F42B 1/028
See application file for complete search history.

(56) References Cited

U.S. PATENT DOCUMENTS 4,841,864 A * 6/1989 Grace ..... F42B 1/02 102/307
6,619,176 B2 * 9/2003 Renfro ..... F42B 1/028 102/307

(Continued)

OTHER PUBLICATIONS

International Search Report of PCT Application No. PCT/US2013/043491 dated Feb. 21, 2014: pp. 1-3.

*Primary Examiner* — Matthew R Buck
*Assistant Examiner* — Douglas S Wood
(74) *Attorney, Agent, or Firm* — Chamberlain Hrdlicka

(57) ABSTRACT

An explosive charge assembly comprises a housing, a liner disposed on a face of an explosive charge, an opening through the liner disposed at the apex, and a lip disposed around the perimeter of the opening. The liner forms an apex and a mouth opposite the apex, and the liner and the explosive charge are disposed in the housing. The explosive charge is disposed between the liner and the housing, and the lip extends from the liner in a direction towards the mouth.

25 Claims, 13 Drawing Sheets

(56) References Cited

U.S. PATENT DOCUMENTS

| | | | | |
|---|---|---|---|---|
| 7,712,416 | B2 * | 5/2010 | Pratt | F42B 1/032 102/307 |
| 8,375,859 | B2 * | 2/2013 | Sagebiel | F42B 1/028 102/306 |
| 9,375,859 | B2 * | 6/2016 | Weber | B26D 7/06 |
| 9,482,499 | B1 * | 11/2016 | Gotzmer | F42B 1/032 |
| 2001/0052303 | A1 | 12/2001 | Mayseless et al. | |
| 2003/0183113 | A1 * | 10/2003 | Barlow | F42B 1/028 102/476 |
| 2009/0050321 | A1 | 2/2009 | Rhodes et al. | |
| 2009/0235836 | A1 | 9/2009 | Pratt et al. | |
| 2009/0255433 | A1 | 10/2009 | Wang et al. | |
| 2011/0056362 | A1 | 3/2011 | Yang et al. | |

* cited by examiner

CTH SIMULATION FOR CONVENTIONAL LINER WITH NO LIP

CTH SIMULATION FOR LINER WITH A LIP AROUND THE APEX HOLE. THIS DESIGN SHOWS A 12% LARGER HOLE SIZE IN THE CASING

LIPPED LINER

LIPPED LINER WITH COPPER INSERT SHOWS A 13% LARGER HOLE SIZE IN CASING

CTH SIMULATION FOR CONVENTIONAL LINER WITH NO INSERT

CTH SIMULATION WITH COPPER INSERT SHOWS A 15% LARGER HOLE SIZE IN CASING

JET PERFORATING DEVICE FOR CREATING A WIDE DIAMETER PERFORATION

BACKGROUND

Wellbores are drilled through subterranean formations to allow hydrocarbons to be produced. In a typical completion, casing is set within the wellbore and retained in place using cement pumped into the annular region between the casing and the wellbore wall. In order to provide fluid communication through the casing and cement for production of hydrocarbons or other fluids, one or more fluid communication passages called perforations may be formed through the casing and cement using a perforating charge in a perforating procedure.

Perforating generally involves disposing a perforating gun at a desired location in a wellbore and firing a perforating gun containing perforating charges to provide the fluid communication through the casing. The fluid communication pathways generally extend through the casing and cement and into the formation. Fluid can then flow through the perforations, cement, and casing into the interior of the wellbore for production to the surface of the wellbore.

SUMMARY

In an embodiment, an explosive charge assembly comprises a housing, a liner disposed on a face of an explosive charge, an opening through the liner disposed at the apex, and a lip disposed around the perimeter of the opening. The liner forms an apex and a mouth opposite the apex, and the liner and the explosive charge are disposed in the housing. The explosive charge is disposed between the liner and the housing, and the lip extends from the liner in a direction towards the mouth.

In an embodiment, a method of perforating comprises detonating an explosive charge assembly, forming a jet in response to the detonating, wherein the additional material contributes to the formation of the jet, engaging a casing with the jet, and forming a perforation through the casing in response to the engagement with the jet. The explosive charge assembly comprises a liner comprising an apex, a mouth opposite the apex, an opening at the apex, and an additional material coupled to the liner adjacent to the opening and extending in a direction towards the mouth.

In an embodiment, a method for making a liner for an explosive charge assembly comprises drawing a material into a concave shape about a central axis of an apex, forming an opening through the material at the apex about the central axis, and providing additional mass around the perimeter of the opening. The apex is centered on the central axis. A mouth is formed at the opposite end from the apex, and the additional mass is coupled to the material and extends in a direction towards the mouth.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
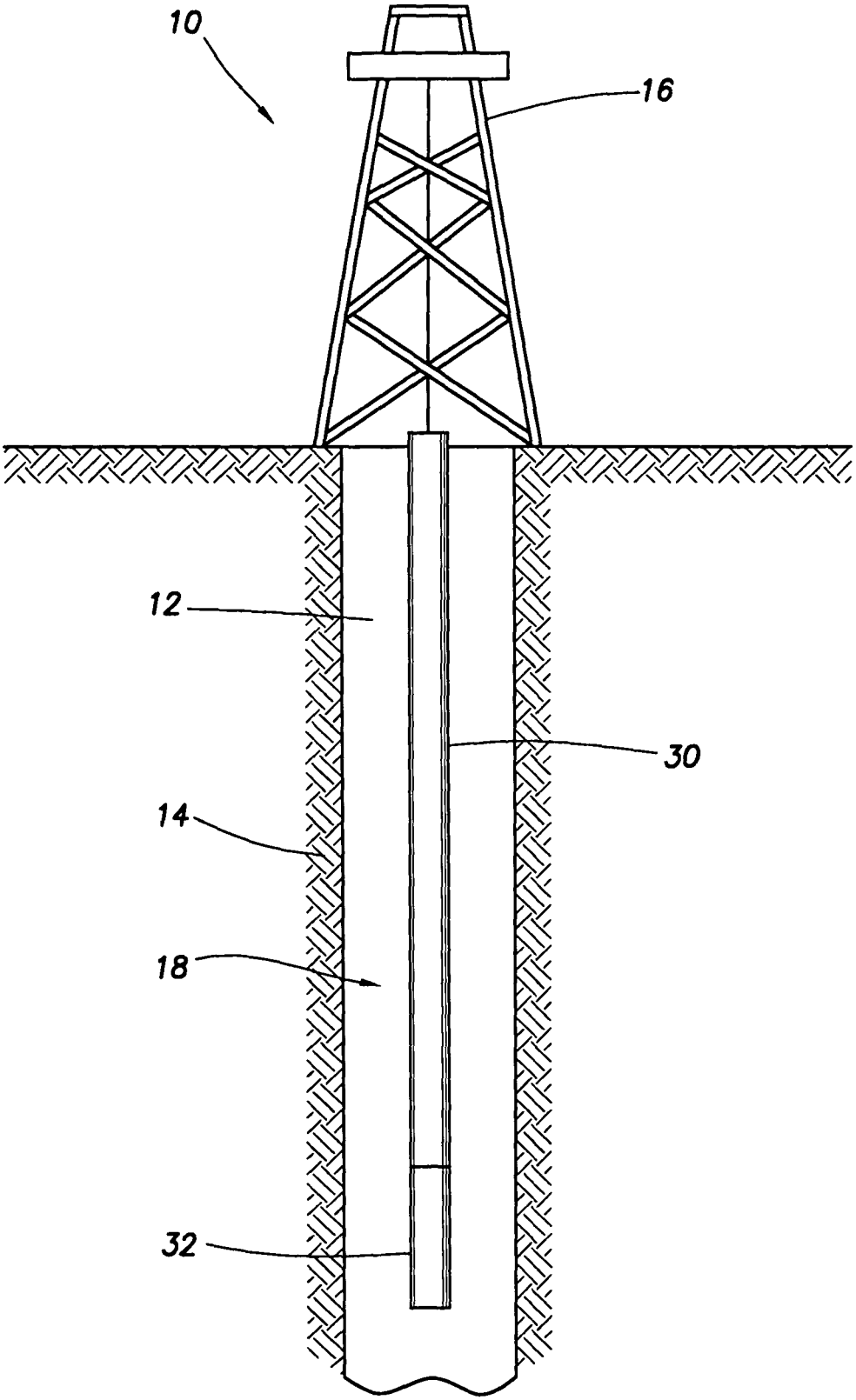
FIG. 1 is a schematic cut-away view of a wellbore servicing system according to an embodiment.

In the drawings and description that follow, like parts are typically marked throughout with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that which is illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward," meaning toward the surface of the wellbore and with "down," "lower," or "downward," meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of several embodiments, and by referring to the accompanying drawings.

An explosive charge assembly, as disclosed herein, may create a larger hole through a wellbore tubular casing providing more flow area for hydrocarbons to enter the wellbore while using a liner with a conventional material thickness. Thus, the explosive charge assembly as disclosed herein may reduce the amount of debris left in the wellbore created by the explosive material. This may be accomplished by an explosive charge assembly with an increased liner mass around a specific area of the liner where the increased mass may affect the formation of the jet, and in some instances, may increase the size of the opening formed through a wellbore casing. Increasing the opening size through a wellbore casing may reduce the velocity in which hydrocarbons enter the wellbore and may help control sanding issues when producing from unconsolidated formations.

The explosive charge assembly, as disclosed herein, may comprise liners having a hole at the apex, where a portion of the material adjacent to the hole may be used to create a lip. The lip may be turned up away from the explosive. The additional mass from the lip around the hole at the apex may affect the way the jet tip forms causing it to spread and hit the casing with a larger diameter than conventional liners. In some embodiments, additional mass may be created with an insert instead of the lip. The additional mass from the insert placed around the opening at the apex may also affect the way the jet tip forms causing it to spread and hit the casing with a larger diameter than conventional liners without the insert. Furthermore, the lip and the insert may be used in conjunction with each other to create the additional mass around the opening at the apex. In an embodiment, the lip may be curled away from the center axis of the explosive charge assembly and in some embodiments engage the insert to secure the insert with the liner.

As illustrated in FIG. 1, a wellbore servicing system 10 comprises a servicing rig 16 that extends over and around a wellbore 12 that penetrates a subterranean formation 14. The wellbore 12 may be used to recover hydrocarbons, store hydrocarbons, dispose of various fluids (e.g., recovered water, carbon dioxide, etc.), recover water (e.g., potable water), recover geothermal energy, or the like. The wellbore 12 may be drilled into the subterranean formation 14 using any suitable drilling technique. While shown as extending vertically from the surface in FIG. 1, in some embodiments the wellbore 12 may be horizontal, deviated at any suitable angle, and/or curved over one or more portions of the wellbore 12. The wellbore 12 generally comprises an opening disposed in the earth having a variety of shapes and/or geometries, and the wellbore 12 may be cased, open hole, and/or lined.

The servicing rig 16 may be one of a drilling rig, a completion rig, a workover rig, a servicing rig, or other mast like structure and may support a wellbore tubular string 18 in the wellbore 12. In some embodiments, a different structure may support the wellbore tubular string 18, for example an injector head of a coiled tubing rig. In an embodiment, the servicing rig 16 may comprise a derrick with a rig floor through which the wellbore tubular string 18 extends downward from the servicing rig 16 into the wellbore 12. In some embodiments, such as in an off-shore location, the servicing rig 16 may be supported by piers extending downwards to a seabed. In some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude seawater. It should be understood that other conveyance mechanisms may control the run-in and withdrawal of the wellbore tubular string 18 in the wellbore 12, for example draw works coupled to a hoisting apparatus, a slickline unit, a wireline unit (e.g., including a winching apparatus), another servicing vehicle, a coiled tubing unit, and/or any other suitable apparatus.

In an embodiment, the wellbore tubular string 18 may comprise any of a variety of wellbore tubulars 30, a perforation tool 32, and optionally, other tools and/or subassemblies located above and/or below the perforation tool 32. The wellbore tubulars 30 may include, but are not limited to, jointed pipes, coiled tubing, any other suitable tubulars, or any combination thereof. In some embodiments, various conveyance mechanisms such as slicklines, wirelines, or other conveyances may be used in place of the wellbore tubulars 30. In an embodiment, the perforation tool 32 comprises one or more explosive charges that may be triggered to detonate, perforating a casing, if present, a wall of the wellbore 12, and/or forming perforation tunnels in the subterranean formation 14. Perforating may allow for the recovery of fluids such as hydrocarbons from the subterranean formation 14 for production at the surface, storing fluids (e.g., hydrocarbons, aqueous fluids, etc.) flowed into the subterranean formation 14, and/or disposed on various fluids in the subterranean formation 14.

In an embodiment, the perforating tool 32 may comprises a plurality of shaped charges. Generally, explosive charge assemblies utilized as well perforating charges include a generally cylindrical or cup-shaped housing having an open end, within which is mounted a shaped explosive generally configured as a hollow cone having its concave side facing the open end of the housing. The concave surface of the explosive is lined with a thin metal liner which is explosively driven to hydrodynamically form a jet of material with fluid-like properties upon detonation of the explosive. This jet of viscous material exhibits a good penetrating power to pierce the well pipe, its concrete liner and the surrounding earth formation. Typically, the explosive charge assemblies are configured so that the liners along the concave surfaces thereof define simple conical liners with a small radius apex at a radius angle of from about 5 degrees to about 60 degrees. Other charges have an a apex with a hemispherical, a half-ellipse, a portion of a parabola, a portion of a hyperbola, a half circle, a cone, a frusto-conical shape, or some other shape fitted with a liner of uniform thickness.

Generally, explosive materials such as HMX, RDX, PYX, or HNS are coated or blended with binders such as wax or synthetic polymeric reactive binders such as that sold under the trademark KEL-F. The resultant mixture is cold- or hot-pressed to approximately 90% of its theoretical maximum density directly into the explosive charge assembly case. The resulting explosive charge assemblies are initiated by means of a booster or priming charge positioned at or near the apex of the explosive charge assembly and located so that a detonating fuse, detonating cord or electrical detonator may be positioned in close proximity to the priming charge.

Explosive charge assemblies may be designed as either deep-penetrating charges or large-diameter hole charges. Generally, explosive charge assemblies designed for use in perforating guns may contain 5 to 60 grams of high explosive and those designed as deep-penetrating charges may typically penetrate concrete from 10 inches to over 50 inches. Large-diameter hole explosive charge assemblies for perforating guns may create holes on the order of about one inch in diameter and display concrete penetration of up to about 9 inches. Such data have been established using API RP43, Section I test methods.

Figure 2:
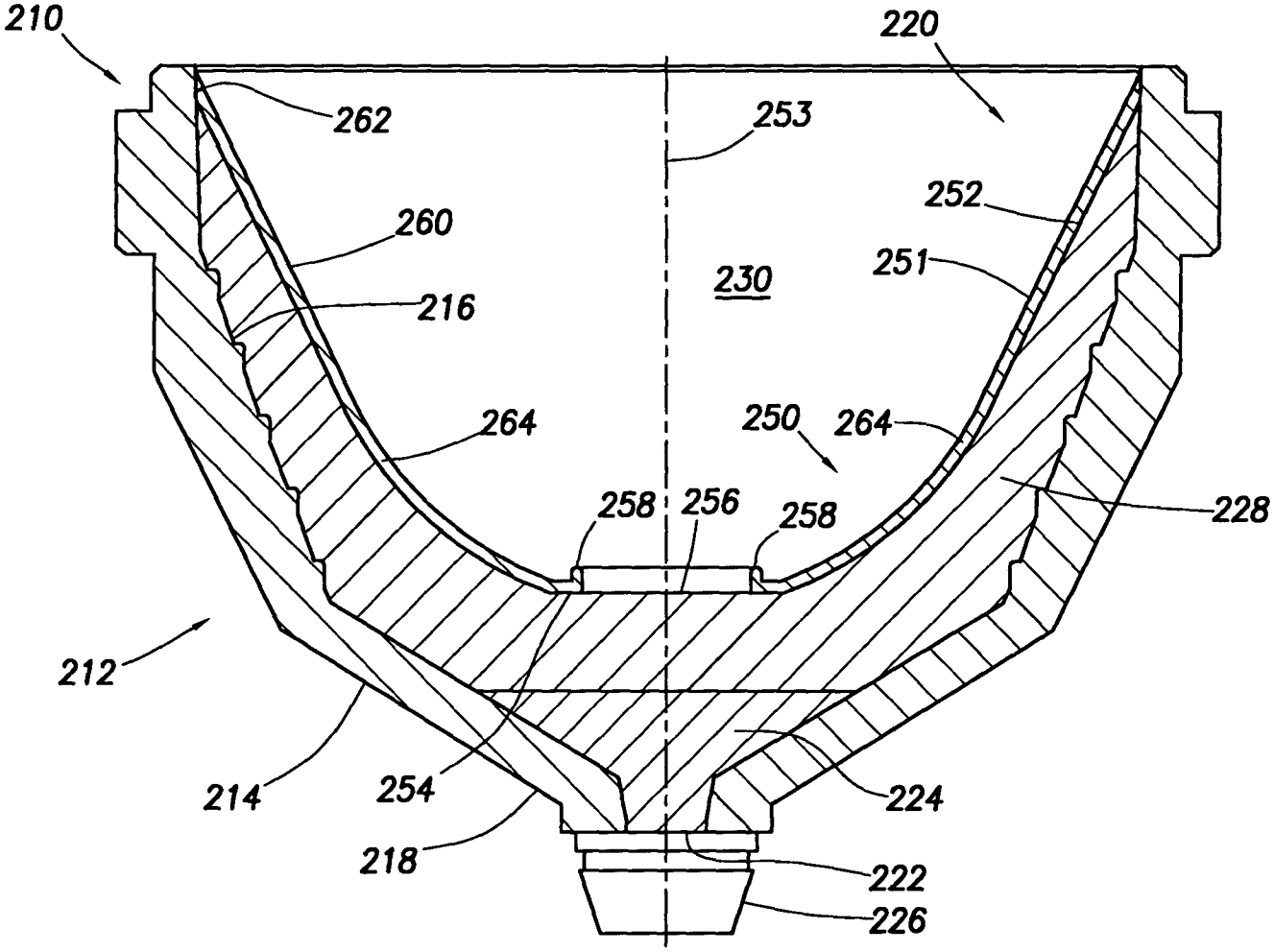
FIG. 2 illustrates a cross-sectional view of an embodiment of an explosive charge assembly.

FIG. 2 is a cross-sectional diagram illustrating an embodiment of an explosive charge assembly 210. The explosive charge assembly 210 may comprise a liner 250 with a hemispherical apex 254. The explosive charge assembly 210 may include a housing 212 having an outer wall 214, an inner wall 216, a base 218, and a mouth 220 opposite the base 218. Within the housing 212 a shaped explosive 228 can be mounted on the inner wall 216 of the housing 212 and can have an open concave side facing the mouth 220 (or mouth portion) of the housing 212.

The housing 212 generally serves to hold the shaped explosive 228 and liner 250 prior to detonation of the explosive charge assembly 210 while providing some degree of containment during the detonation to allow for the formation of the jet. In order to provide the shaped charge geometry, the housing 212 generally comprises a bowl-like structure configured to retain the explosive charges and liners. In an embodiment, the housing as shown in FIG. 2 comprises a solid of revolution. The housing 212 may comprise a variety of shapes, and the wall thickness along the length may be substantially uniform, or in some embodiments, the wall thickness may vary along the length of the casing. While illustrated in FIG. 2 as having a rigid bowl-like shape, the housing 212 may comprise any variety of shapes including, but not limited to curved, elliptical, conical, cylindrical, or any combination thereof. The housing 212 may be formed from any suitable material such as a metal (e.g. steel, aluminum, tungsten, etc.), a composite material (e.g., reinforced polymers), a ceramic, or any combination thereof.

The housing 212 may also contain a chamber 222 to hold an initiation charge 224. The initiation charge 224 may be larger than chamber 222 and flows into the area of the housing 212 of the main shaped explosive 228. The initiation charge 224 is generally configured to aid in transferring the explosive detonation from a detonator cord to the shaped explosive 228. The initiation charge 224 may be triggered by an explosive member such as a detonator cord at the base 218 of the housing 212. A passageway may be formed in at the base 218 of the housing 212 for receiving the detonator cord and retaining the detonator cord in a configuration for passing the explosive detonation from the detonator cord to the initiation charge 224 and the shaped explosive 228 within the housing 212.

The shaped explosive 228 and/or the initiation charge 224 may comprise any suitable explosive. In an embodiment, the shaped explosive 228 may comprise, lead azide, pentaerythritol tetranitrate (PETN), cyclotrimethylene trinitramine (RDX), hexanitrostilbene (HNS), cyclotetramethylene tetranitramine (HMX), bis(picrylamino) trinitropyridine (PYX), any other suitable explosives used with a shaped charge, or any combination thereof. The shaped explosive 228 may generally be provided as a powdered or granular component that is pressed into the appropriate shape using a die or other suitable press for use with the shaped charge 210.

Generally, the liner 250 may be formed from any of a variety of materials, such as deep drawn or die stamped sheet metal, or die pressed, and optionally fully or partially sintered metal powder. The liner 250 may also be a molding which includes a metal loaded polymer matrix. As used herein, the term "matrix" means a material in which another material is dispersed, and the term "loaded" means contained within. Thus, the liner 250 molding may include a polymer material in which metal is dispersed. The metal in the polymer matrix may be in the form of a powder, or a combination of powders. In some embodiments, the liner 250 may comprise a pressed, powdered metal, which may be held together by green strength. The metal or metals used to form the liner 250 may include, but is not limited to, copper, tungsten, lead, molybdenum, tantalum, nickel, iron, zinc, aluminum, or any combination thereof. Of course, it is not necessary for the metal to be in powder form, although powder is convenient for mixing with any additional components in the molding process. Furthermore, other metals and other types of metals may be used without departing from the principles of the embodiments disclosed herein. It is to be clearly understood that it is not necessary for the liner 250 to be made entirely of a molding, or for the molding to comprise only the liner. For example, the molding could be shaped so that it includes features for attaching the liner 250 to the case, etc. Additionally, the liner 250 may have portions thereof which are not molded, or which are not molded of a metal loaded polymer matrix. In some embodiments, the liner 250 may comprise various components to assist in self-adhering of the powdered material particles of the shaped explosive 228, to lubricate the die set used to form the liner 250, and/or to reduce wear on the die set and/or other tools. For example, the liner 250 may comprise various waxes, binders, lubricants, and anti-static agents to aid in forming the liner. The liner 250 may have a concave inner surface 251, a convex outer surface 252, an apex 254 (or apex portion), and a mouth opposite the apex 254 (illustrated here contiguous to mouth 220 of housing 212).

The apex 254 may have a center at a point where the apex 254 intersects the central axis 253 about which the liner is radially symmetric. The embodiment illustrated in FIG. 2 may further include an opening 256 at the center of the apex 254. The opening 256 may comprise a diameter which is smaller than the diameter of the mouth 220. In an embodiment, the diameter of the opening 256 may be greater than about 0.5%, about 1%, about 2%, about 3%, about 4%, about 5%, about 6%, about 7%, about 8%, about 9%, or about 10% of the diameter of the mouth 220. In an embodiment, the diameter of the opening 256 may be less than about 50%, about 45%, about 40%, about 35%, about 30%, about 25%, about 20%, about 15%, or about 10% of the diameter of the mouth 220. In an embodiment, the diameter of the mouth may be between 0.200 inches and 0.450 inches and may depend on the particular type of charge. The liner 250 may also include a skirt portion 260 terminating in a circular skirt edge 262 at the mouth 220 of the liner 250 on the opposite end of the liner from the apex 254. The liner 250 may line the concave side of the shaped explosive 228 leaving an open space 230 between the concave inner surface 251 of the liner and the mouth 220 of the housing.

Except at the opening 256, the shaped explosive 228 may be bounded by the housing inner wall 216, the initiation charge 224, and the convex outer surface 252 of the liner 250. At the opening 256 of the liner 250, the explosive charge may be in direct contact only with the open space 230 in the housing. The only material blocking this direct contact may be a coating disposed over the explosive. The coating may have a thickness less than about 10%, about 20%, about 30%, about 40%, about 50%, about 60%, about 70%, about 80%, about 90%, about 100%, about 150%, about 200%, about 250%, or about 300% of the thickness of the liner 250 around the opening 256. The coating may be applied over the center opening 256 after the liner 250 has been inserted into the housing 212. The coating may cover the entire opening 256, and in some embodiments may have some overlap onto the surface of the liner 250. The coating may contact the shaped explosive 228 and the open space 230 between the liner 250 and the mouth 220 of the housing 212.

The embodiment illustrated in FIG. 2 depicts a lip 258. The lip 258 may be disposed around the perimeter of the opening 256. The lip 258 adds mass around and/or adjacent to the opening 256. The lip 258 may allow the jet (e.g. the stream of particles) to perforate a casing and create an opening having a greater diameter than a comparative perforation formed from an explosive charge assembly without the lip 258. In an embodiment, the lip 258 may allow the jet to perforate a casing and create an opening having a diameter greater than about 0.1%, about 0.5%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% greater than a comparative perforation formed from an explosive charge assembly without the lip 258. The opening may generally be less than about 200% or about 150% a comparative perforation formed from an explosive charge assembly without the lip 258. In an embodiment, the opening formed through a casing may be at least as large as a comparative perforation formed from an explosive charge assembly without the lip 258. The lip 258 may extend from the liner 250 in a direction towards the mouth 220. The lip 258 may be integrated with the liner 250 such that the lip 258 and the liner 250 are one continuous piece. In some embodiments, the lip 258 may be formed by using a separate piece that is coupled to the liner within the opening. In an embodiment, the lip 258 may extend above the surface of the liner 250 a distance of at least about 10%, about 20%, about 30%, about 40%, about 50%, about 60%, about 70%, about 80%, 9 about 0%, or about 100% of the thickness of the liner 250. In an embodiment, the lip 258 may extend above the surface of the liner 250 a distance of less than about 500%, about 450%, about 400%, about 350%, about 300%, about 250%, about 200%, or about 150% of the thickness of the liner 250. In an embodiment, the lip 258 may comprise a height between about 0.001 inches and 0.1 inches. As used herein, the "height" of the lip 258 may refer to the distance between the surface of the liner 250 within the open space 230 and the top of the lip closest to the mouth 220. In an embodiment, the lip 258 may comprise a length between about 0.001 inches and about 0.2 inches. As used herein, the "length" of the lip may refer to the distance of the lip 258 from the inner perimeter of the opening 256 to the outer end of the lip 258 away from the center axis 253 along the length of the liner 250.

Figure 3A:
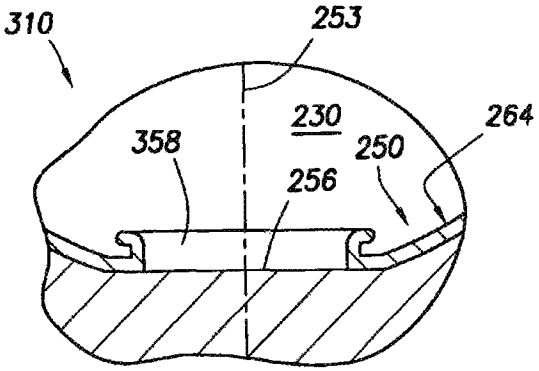
FIGS. 3A-3D illustrate cross-sectional views of embodiments of explosive charge assemblies.
Figure 3B:
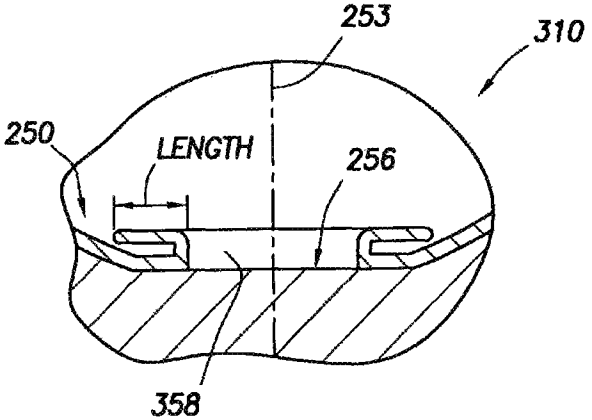
Figure 3C:
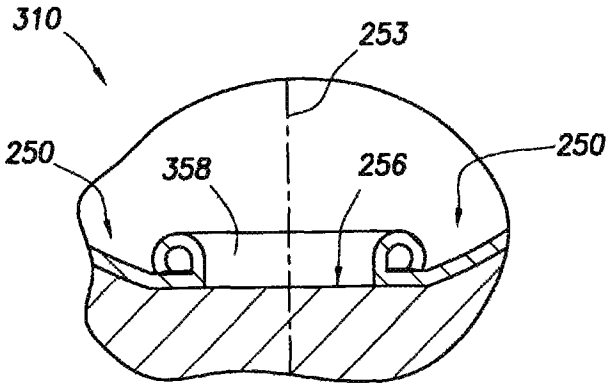
Figure 3D:
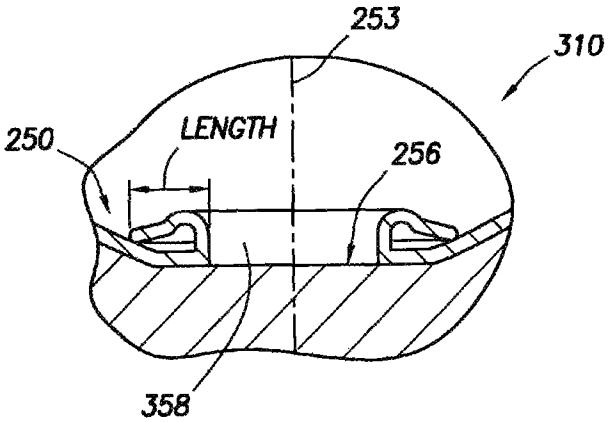

FIG. 3A illustrates an embodiment of an explosive charge assembly 310. FIG. 3A may comprise one or more of the components of the explosive charge assembly 210 of FIG. 2 and similar components will not be discussed in the interested of clarity. Alternatively, explosive charge assembly 310 of FIG. 3A may comprise a lip 358. Similar to the lip 258 illustrated in FIG. 2, the lip 358 may engage the liner 250 around the perimeter of the opening 256 and may extend from the liner 250 in a direction towards the mouth 220. The lip 358 may comprise a turn, which turns the tip of the lip 358 away from the center axis 253 of the shaped charged 228. In an embodiment, the lip 358 may turn away from the center axis 253 of the shaped charged and additionally curl back toward the base of the lip 358. For example, as shown in FIG. 3B, the length of the curl may extend along the liner 250. The curl may not engage the liner 250 or the base of lip 358. The curl may be used to secure an insert (to be discussed further herein) placed at least partial between the curl of the lip 358 and the liner 250 around the perimeter of the opening 256. As shown in FIG. 3C, the curl of the lip 358 may be rolled back towards the liner 250 and/or the base of the lip 358. In this embodiment, the tip of the lip 358 that is curled back may engage the liner 250, the base of the lip 358, or an insert (to be discussed further herein) so that a cavity is formed by the curl of the lip 358. As shown in FIG. 3D, the curl of the lip 358 may be crimped against the liner 250 or in some embodiments an insert to be discussed further herein.

Figure 4:
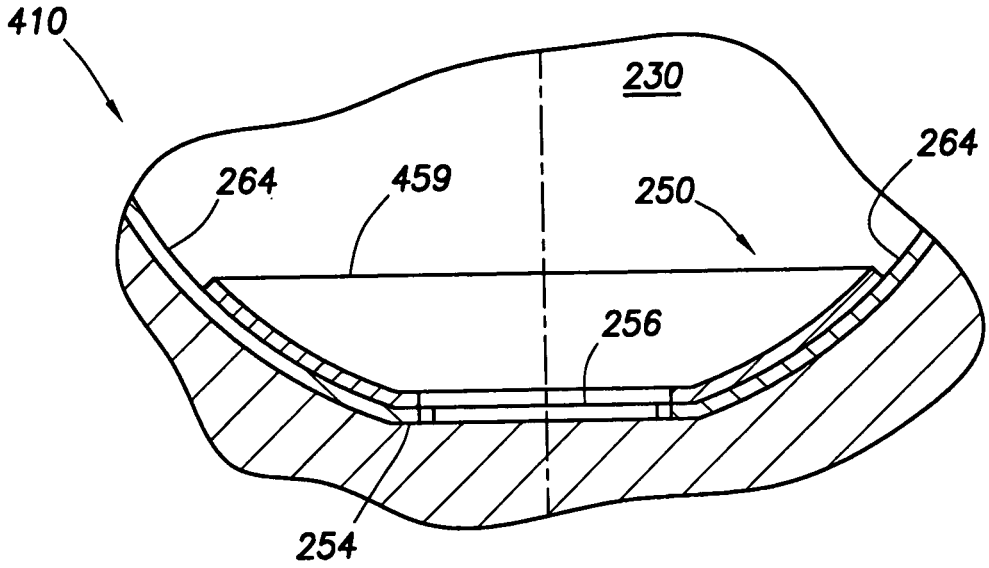
FIG. 4 illustrates a cross-sectional view of another embodiment of an explosive charge assembly.

FIG. 4 illustrates an embodiment of an explosive charge assembly 410. The explosive charge 410 may comprise one or more of the components of the explosive charge assembly 210 of FIG. 2 and/or explosive charge assembly 310 of FIG. 3A. However, the explosive charge assembly 410 may comprise an insert 459 rather than a lip. As used herein, the term insert may refer to any component that is formed on or added to the liner 250 at or near the apex to add mass around and/or adjacent to the opening 256. In general, the insert 459 may comprise a pre-formed component that is added to the liner. In some embodiments, the insert 459 may be directly formed on the liner 250 such as by pressing a powder into the shape of the insert 459 on the liner 250 after the liner 250 is formed.

In an embodiment, the insert 459 may be coupled to the liner 250 and extend toward the mouth 220 of the explosive charge assembly 410. For example, the insert 459 may comprise a ring of material having an opening at the center. The ring may be shaped so that it may be coupled to the surface of the liner 250 around the apex (e.g. flush against the surface of the liner 250) and extend towards the mouth 220. The ring may comprise various shapes configured to mate with the shape of the liner, or fit within the liner and leave one or more voids. In another example, the insert 459 may comprise pressed powder such as explosive charge powder. The pressed powder may be stamped around the perimeter of the opening 256 coupling the pressed powder to the liner 250 and forming the pressed powder so that it extends towards the mouth 220.

The additional material added at the apex of the liner by the insert 459 may allow the jet (e.g. the stream of particles) to perforate in a casing and create an opening having a greater diameter than a comparative perforation formed from an explosive charge assembly without the insert 459. In an embodiment, the insert 459 may allow the jet to perforate in a casing and create an opening having a diameter greater than about 0.1%, about 0.5%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% greater than a comparative perforation formed from an explosive charge assembly without the insert 459. The opening may generally be less than about 200% or about 150% a comparative perforation formed from an explosive charge assembly without the insert 459. The insert 459 may extended a distance along the liner 250 from the perimeter of the opening 256 towards the mouth 220. The distance the insert 459 may extend along the liner 250 from the perimeter of the opening 256 to the mouth 220 may be less than about 75%, about 70%, about 65%, about 60%, about 55%, about 50%, about 45%, about 40%, about 35%, about 30%, about 25%, about 20%, about 15%, or about 10% of the distance from the perimeter of the opening 256 to the mouth 220. In an embodiment, distance the insert 459 may extend along the liner 250 from the perimeter of the opening 256 to the mouth 220 may be greater than about 0.1%, about 1%, about 2%, about 3%, about 4%, about 5%, or about 10% the distance from the perimeter of the opening 256 to the mouth 220.

The insert 459 may comprise an opening therethrough that generally has a diameter that is about the same as or greater than the diameter of the opening 256. Thus, the insert 459 may be positioned on the liner 250 so that insert 459 rests on the liner 250 and the opening 256 is unobstructed by the insert 459. In some embodiments, the diameter of the opening in the insert 459 may be less than the diameter of the opening in the liner 250. The opening in the insert 459 may then define the exposed portion of the explosive. In this embodiment, the insert 459 may have a downward extension on its interior that extends into the opening in the liner 250, which may serve to retain the insert 459 in position on the liner 250. Generally, the thickness of the insert 459 is relatively uniform along the length of the insert 459, though in some embodiments, its thickness may change. For example, the insert 459 may be thicker near the opening 256 and thinner towards the edge closest to the mouth 220. The thickness of the insert 459 may comprise a thickness which is greater than about 10%, about 20%, about 30%, about 40%, about 50%, about 60%, about 70%, about 80%, about 90%, or about 100% the height of the lip 358, and less than about 100%, about 150%, about 200%, about 250%, about 300%, about 350%, about 400%, 4 about 50%, or about 500% the thickness of the liner 250 adjacent to the opening 256. The insert 459 may be retained on the liner 250 during the pressing process, by administering an adhesive on the liner 250 (e.g. a paint and/or a glue) and using the adhesive to retain the insert 459, by fastening (e.g. welding) the insert 459 to the liner 250, by heating the insert 459 so that it blends with the liner 250, and/or by relying on the green strength of a pressing force of the insert 459 into the liner 250. In an embodiment, the insert 459 may be retained by attaching it to an edge of the opening 256. The insert 459 may comprise copper, brass, and/or any other material having a similar density, and in some embodiments, the insert 459 may comprise any of the materials used to form the liner.

Figure 5A:
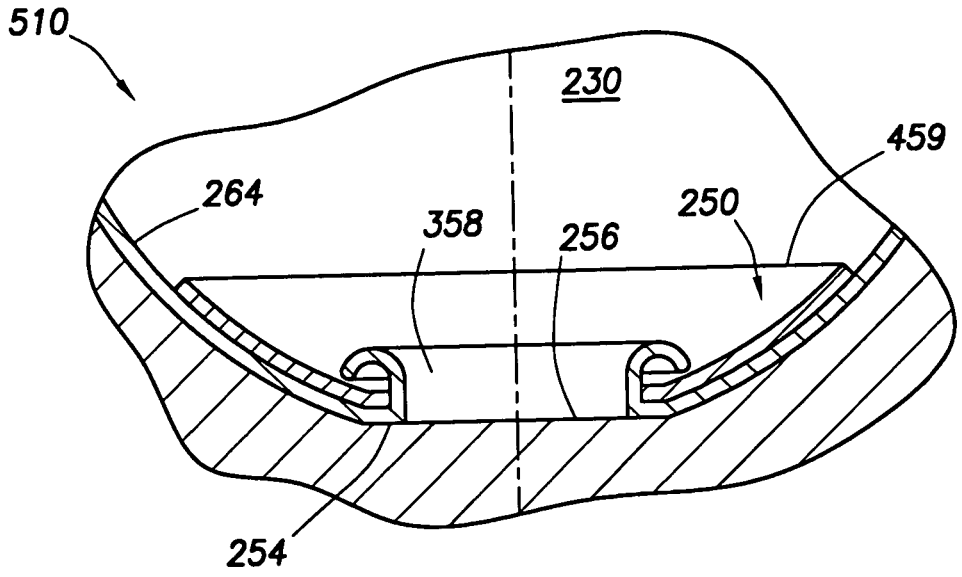
FIGS. 5A-5D illustrate cross-sectional views of still other embodiments of explosive charge assemblies.
Figure 5B:
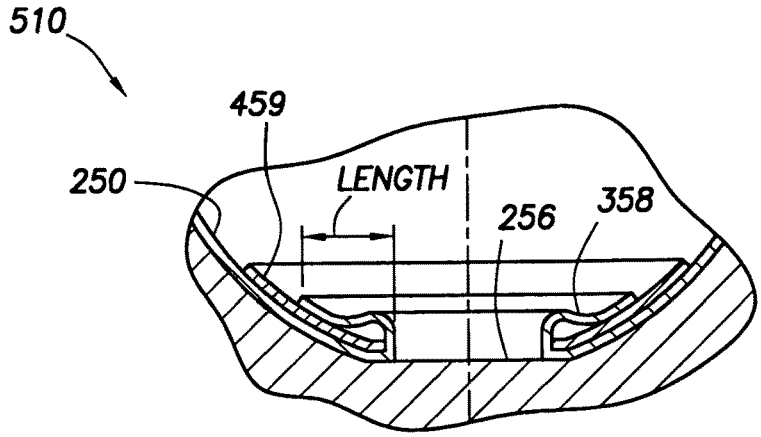
Figure 5C:
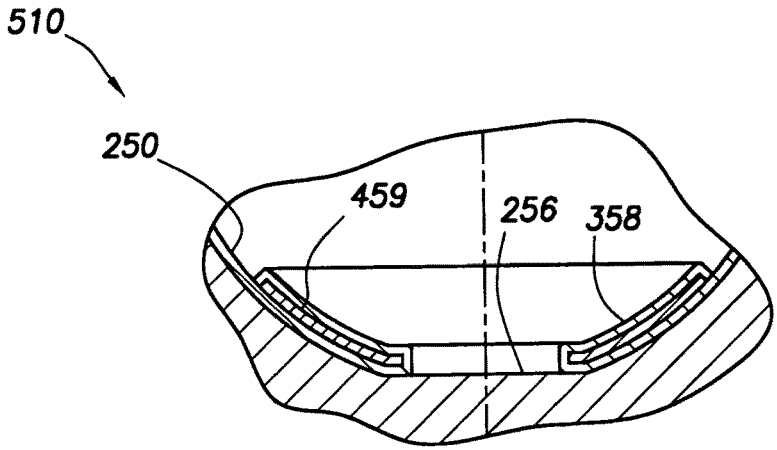
Figure 5D:
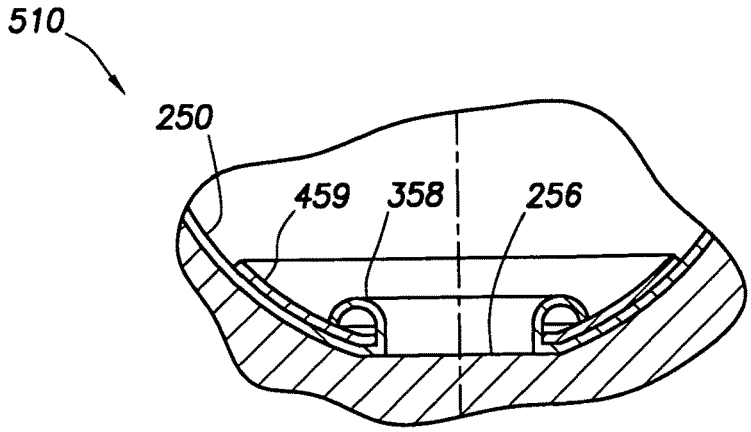

FIG. 5A illustrates an embodiment of an explosive charge assembly 510. The explosive charge 510 may comprise one or more of the components of the explosive charge assembly 210 of FIG. 2, explosive charge assembly 310 of FIG. 3A, and/or explosive charge assembly 410 of FIG. 4. However, the explosive charge assembly 510 may comprise both the lip 358 and the insert 459. The lip 358 and the insert 459 may add mass around and/or adjacent to the opening 256. The lip 358 and the insert 459 may allow the jet (e.g. the stream of particles) to perforate in a casing and create an opening having a greater diameter than a comparative perforation formed from an explosive charge assembly without the lip 358 and/or without the insert 459. In an embodiment, the lip and insert 459 may collectively allow the jet to perforate in a casing and create an opening having a diameter greater than about 0.1%, about 0.5%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% greater than a comparative perforation formed from an explosive charge assembly without the lip 358 and the insert 459. The opening may generally be less than about 200% or about 150% a comparative perforation formed from an explosive charge assembly without the lip 358 and without the insert 459. As shown in FIGS. 5B, 5C and 5D, the lip 358 may comprise a turn or a curl that engages the surface of the insert 459 for example to secure the insert 459 around the apex 254 over the liner 250. As shown in FIG. 5B, the turn in the lip 358 may engage at least a portion of the length of the surface of the insert 459. The turn may engage about 1%, about 10%, about 20%, about 50%, about 75%, or about 100% of the length the insert 459 along the liner 250. In an embodiment, the turn in the lip 358 may engage the surface of the insert 459 and may extend off the surface of the insert towards the mouth 220 substantially parallel with liner 250. As shown in FIG. 5C, the turn in the lip 358 may engage the surface of the insert 459 and wrap around insert 459 so that the turn in the lip 358 also engages the liner 250. Additionally, as shown in FIG. 5D, the turn in the lip 358 may curl so that the tip of the lip 358 engages the surface of the insert 459. The lip 358 oriented in a curl shape, as shown in FIG. 5D, forms a cavity around the perimeter of the opening 256.

Any suitable method may be used to form the explosive charge assemblies as described herein. In an embodiment, the method for making the liner calls for drawing the chosen material, (e.g., from a flat state) into a concave shape radially symmetric about a central axis passing through and perpendicular to the center of the apex, where radial symmetry about an axis is intended to describe concentricity about such axis within any plane defined perpendicular to such axis and intersecting such axis. In this process the center of the material is drawn down to form the apex while the perimeter of the material forms a skirt portion terminating in a circular skirt edge at the mouth of the liner. Depending on the desired apex shape and other factors, the draw may be done in a single step or may be done in several steps. For a hemispherical apex, a single step draw may be used. Multiple step draws tend to leave several necking points near each radial transition, but these are generally smaller and less well defined. Multiple step draws can be used when the apex profile is parabolic. In an embodiment, the material comprises a metal. For example, the material may be selected from the group of copper, copper alloy, aluminum, aluminum alloy, tin, tin alloy, lead, lead alloy, brass, tungsten, and the like.

In an alternative method of manufacture, the liners of the present invention may be manufactured by spinning a sheet of material into a concave shape radially symmetric about a central axis, having an apex centered on the central axis and a mouth at the opposite end from the apex, wherein a portion of the material forms the apex and a portion of the material forms a skirt portion terminating in a circular skirt edge at the mouth of the liner. Following the spinning process any excess material outside the circular skirt edge forming the mouth may be removed. If an opening in the apex is desired, this may be accomplished by the use of a punch or drill, after the completion of the spinning process. The spun liner may provide an additional liner thickness at the apex greater than the skirt thickness and thus provide additional mass around the apex of the liner.

In order to form the opening in the apex, a punch may be implemented to punch the opening in the apex centered on the central axis. This may occur in the same sequence as the drawing process to increase reliability of the central axis for the punch being aligned with the central axis for the draw. Other alternatives to the use of a punch to create the hole include drilling, honing, sawing, or chemically etching. Generally, the opening comprises a diameter which is smaller than the diameter of the mouth of the liner.

The draw can be performed from a sheet of material, but may also be performed on pre-cut and sized discs or other shaped blanks. At the conclusion of the draw, either as a final step in the drawing process using the drawing tools, or as a separate step, any excess flat material from the sheet or blank outside of the circular skirt edge forming the mouth of the liner must be removed. Additionally, in some embodiments, following removal of any excess flat material, an additional step may be undertaken to trim the height of the liner to a desired size.

In addition to obtaining the liner through drawing, a lip may be formed around the perimeter of the opening, where the lip extends from the material drawn down to form the apex in a direction towards the mouth. The drawing of the liner and/or the formation of the opening may result in the creation of a lip in the material around the perimeter of the opening. The drawing of the liner, the formation of the opening, and the forming of the lip around the perimeter of the opening may all occur in a single stage, step, and/or manufacturing process. In an embodiment, the lip may be attached to the liner around the perimeter of the opening and may be fixed with the liner in the same stage, step, and/or manufacturing process as the drawing of the liner and/or the forming of the opening. Alternatively, fixing the lip with the liner may occur in a separate stage, step, and/or manufacturing process.

Furthermore, an insert may be placed around the circumference of the apex of the liner. The insert may be placed around the apex of the liner as the liner is being formed. In an embodiment, the insert may comprise an opening as previously disclosed which is formed before the insert is engaged with the liner. Thus, when the insert engages with the liner, the lip, which may have been previously formed, for example, when the liner was drawn, may not obstruct the insert from engaging with the surface of the liner. Alternatively, the lip may not be formed or may be formed after the opening through the insert is formed. For example, as the opening through the liner is formed, the opening through the insert may be also formed, such as by using a single punch to create both openings. Because the presence of a lip may obstruct the punch from creating an opening through both the liner and the insert, the lip may be formed after the creation of the opening through the insert. Regardless, it should be understood that the diameter of the opening through the insert may be greater than the diameter of the opening through the liner so that the lip may be formed and/or fit through the opening of the insert.

In an embodiment, the forming of the lip may comprise extending the lip away from the center axis of the liner, wherein the center axis passes through the center of the opening. In an embodiment, this feature, which may be referred to as a curl and/or a turn in the lip, may be formed when the lip is formed. For example, the liner, opening and insert may have previously been formed in the shaped charge. Subsequently, the lip comprising the curl may be formed so that the curl in the lip engages the surface of the insert securing the insert to the surface of the liner. Alternatively, the liner, opening, insert and lip may be formed before the curl in the lip is formed. For example, the liner, opening, insert, and lip may have previously been formed in one or more stages, steps, and/or manufacturing processes. The curl in the lip may be formed separately from the formation of the lip so that the curl may engage the surface of the insert securing the insert to the surface of the liner.

Figure 6:
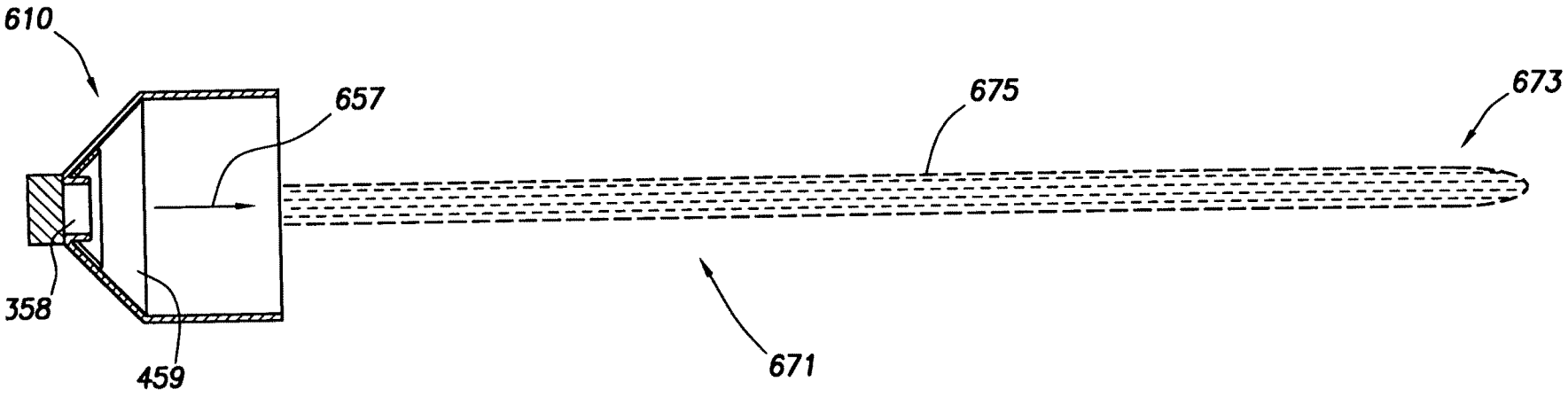
FIG. 6 schematically illustrates a jet formed by an embodiment of an explosive charge assembly.

A method of perforating, for example a casing in a wellbore tubular, is disclosed. As schematically illustrated in FIG. 6, the energy of a detonation of the explosive charge assembly 610, due for example to the propagation of a detonation from the detonator cord coupled to the explosive charge assembly 610, can be concentrated and/or focused along the explosive focus axis 657 to form a jet 675 indicated by a dotted line. A portion of the liner as well as the lip 358 and/or the insert 459 may be accelerated by the energy of the detonation and form the leading edge 673 of the jet 675, which may be followed by the trailing edge 671 of the jet 675 as the detonation continues and eventually ends. As the detonation continues, generally from the center of the explosive charge assembly 610 outwards, the liner as well as the lip 358 and/or the insert 459, feed the jet 675 as it is accelerated along the focused path 657. In an embodiment, the liner as well as the lip 358 and/or the insert 459 each contribute to the formation of the jet 675. The resulting jet 675 generally comprises a coherent stream of particles that can penetrate the adjacent formation to form a perforation tunnel. A coherent jet is a jet that consists of a continuous stream of small particles. A non-coherent jet contains large particles or is a jet comprised of multiple streams of particles. In general, a jet stream that is coherent may have a greater penetration depth than the penetration depth of non-coherent jet streams.

Various factors can affect the formation of the jet 675 during the detonation of the explosive charge assembly 610. For example, the speed at which the liner as well as the lip 358 and/or the insert 459 are accelerated affects the degree to which the resulting jet forms a coherent jet, and a speed greater than a threshold (e.g., the speed of sound in the liners) may result in a non-coherent jet. Increasing the collapse speed of the liner as well as the lip 358 and/or the insert 459 may tend to increase the jet tip speed, which may be useful in providing improved penetrating potential. The choice of materials for forming the liner as well as the lip 358 and/or the insert 459 can affect the threshold speed for forming a coherent jet, and therefore the penetrating potential for the explosive charge assembly. In addition, the density and ductility of the liners can affect the explosive charge assembly performance. The density of the jet can be controlled by utilizing a dense liner material. Jet length may be affected by the jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by the selection of the liner material and geometry, as described in more detail above. In general, it is expected that the jet length may increase with an increase in the jet tip velocity as well as an increase in the jet velocity gradient.

Returning to FIG. 2, a jet may be formed as an explosive charge assembly 210 is detonated. The detonation may be provided by a detonation traveling along a detonator cord, which may be initiated using a detonator assembly. The detonation may be conveyed through the detonator cord, to the booster charge 224 if present, and into the shaped explosive 228. The detonation may generally proceed from the area adjacent the booster charge 224 outwards, resulting in the liner material, the lip 358, and/or the insert 459 near the apex portion forming the leading edge of the jet. As the detonation occurs, each of the liner, the lip 358, and/or the insert 459 may feed the jet and contribute to the formation of a coherent jet.

Figure 7:
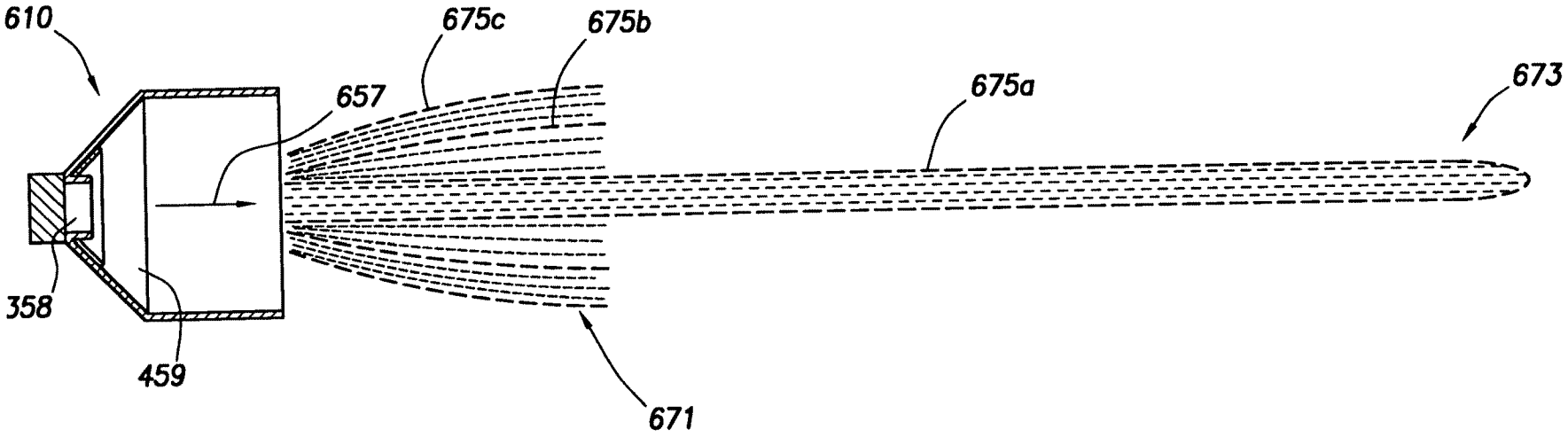
FIG. 7 schematically illustrates a jet formed by an embodiment of an explosive charge assembly.

Turning to FIG. 7, the use of the lip 358, and in some embodiments, the insert 459 may result in a jet having an increased width relative to an explosive charge assembly without the lip 358. In an embodiment, the explosive charge assembly 610 comprising the lip 358 and/or insert 459, may create a jet 675*b* which creates a perforation, for example through a casing, having a diameter greater than about 0.1%, about 0.5%, about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, or about 20% greater than a perforation created by a jet 675*a* formed from an explosive charge assembly without a lip and/or insert, respectively. The resulting jet may engage a wellbore tubular wall (e.g., a casing wall, etc.), a cement layer, and/or a subterranean formation to form a perforation there through. For example, the jet may engage the subterranean formation to form a perforation tunnel therein. The jet having an increased width may provide a larger fluid flow path.

In an embodiment, a plurality of explosive charge assemblies may be detonated within a wellbore. The plurality of explosive charge assemblies may be provided in one or more perforating guns, which may form at least a portion of a perforating gun string disposed within the wellbore. The plurality of explosive charge assemblies may be retained within a charge carrier within the one or more perforating guns. A detonation cord may extend through the charge carrier and be coupled to the plurality of explosive charge assemblies. Upon the initiation of the detonation in the detonator cord, the detonation may be transferred to the plurality of explosive charge assemblies and initiate a detonation in the plurality of explosive charge assemblies. One or more of the explosive charge assemblies may comprise a housing, a liner disposed within the housing, an opening through the liner disposed at the apex and about the central axis of the assembly, and a lip disposed around the perimeter of the opening, wherein the lip extends from the liner in a direction towards the mouth. In an embodiment, the one or more of the explosive charge assemblies may also comprise an insert disposed on the liner around the opening and adjacent to the lip. The detonation may result in the formation of a jet, where the liner, lip and insert each contribute to the material in the jet. The jet may have a width that creates an increased perforation diameter relative to a perforation diameter created by a jet formed by an explosive charge assembly without the lip or the lip and insert. The jets may penetrate the subterranean formation surrounding the wellbore to form a plurality of perforation tunnels. The perforation guns may then be removed from the wellbore. A variety of workover, completion, and/or production operations may be performed after the perforating procedure. One or more fluids (e.g., hydrocarbons, water, etc.) may then be produced from or injected into the perforation tunnels, which may form pathways into the subterranean formation.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

Example 1

In order to illustrate the benefits of the explosive charge assemblies as described herein, the effects of various liners, lips, and or inserts in perforating charges were modeled using CTH, a shock hydro code. The CTH suite of computer code is a flexible software system designed to treat a wide range of shock wave propagation and material motion phenomena in one, two, or three dimensions. The CTH code was used to model the effects of the detonation of a perforation charge. The charge parameters in terms of the design of the housing, explosive charge, and liner were held constant during several modeling runs. Four variations then included: 1) a base case with no lip or liner, 2) a liner with a lip around the apex hole, 3) a second liner with a lip around the apex hole, and 3) a liner with both a lip and an insert around the apex hole.

Figure 8:
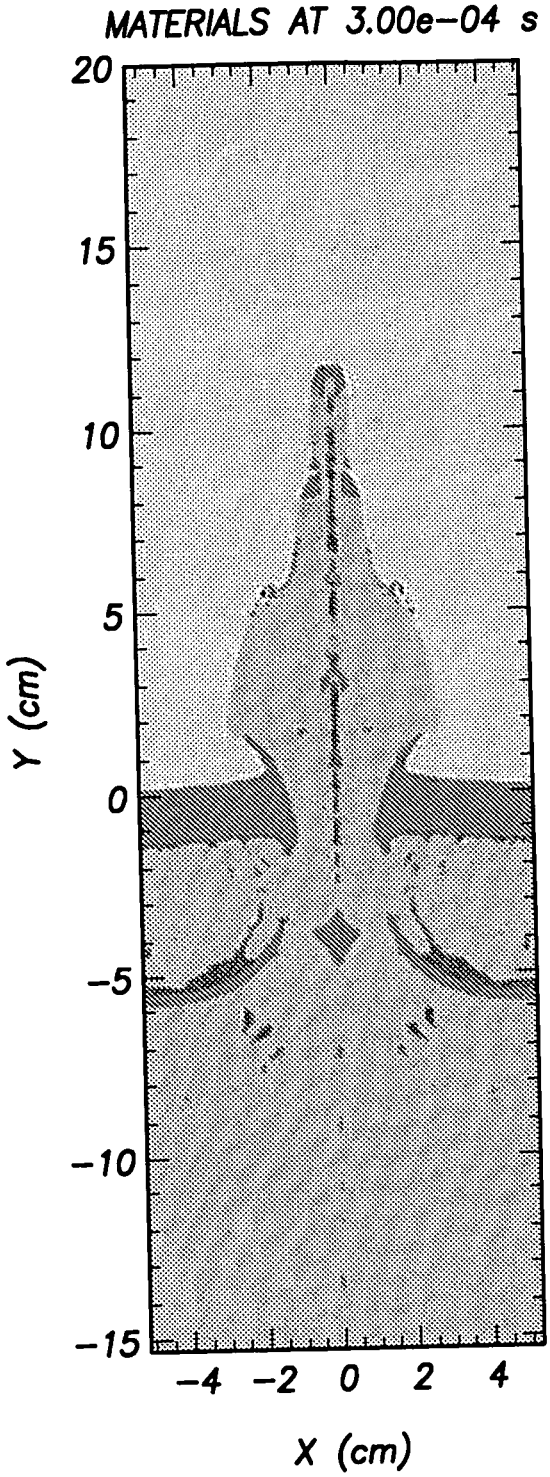
FIG. 8 illustrates modeling results of a perforation through a casing using a jet formed by an embodiment of an explosive charge assembly.

For the first charge case, a base case with no lip was modeled. The grid resolution used in CTH was 0.02 cm. The Mie-Gruneisen Equation of State (EOS) models inherent to CTH were used for the casing steel, shaped charge zinc case, shaped charge brass liner, and copper insert. Furthermore, a Jones-Wilkins-Lee (JWL) EOS model from CTH was used for the HMX explosive within the shaped charge. HMX explosives are in the class of nitroamine high explosives. The molecular structure of HMX consists of an eight-membered ring of alternating carbon and nitrogen atoms with a nitro group attached to each nitrogen atom. A SESAME EOS was used for the water and dry sand target. Von Mises strength models were used for the shaped charge zinc case and copper insert. Johnson-Cook strength models were used for the shaped charge brass liner. A custom generated Zerilli-Armstrong model was used for the casing steel. A geological yield surface model was used for the dry sand target. The results of the model are shown in FIG. 8. The results provide a base, comparative case for comparison with the next three examples.

Example 2

Figure 9:
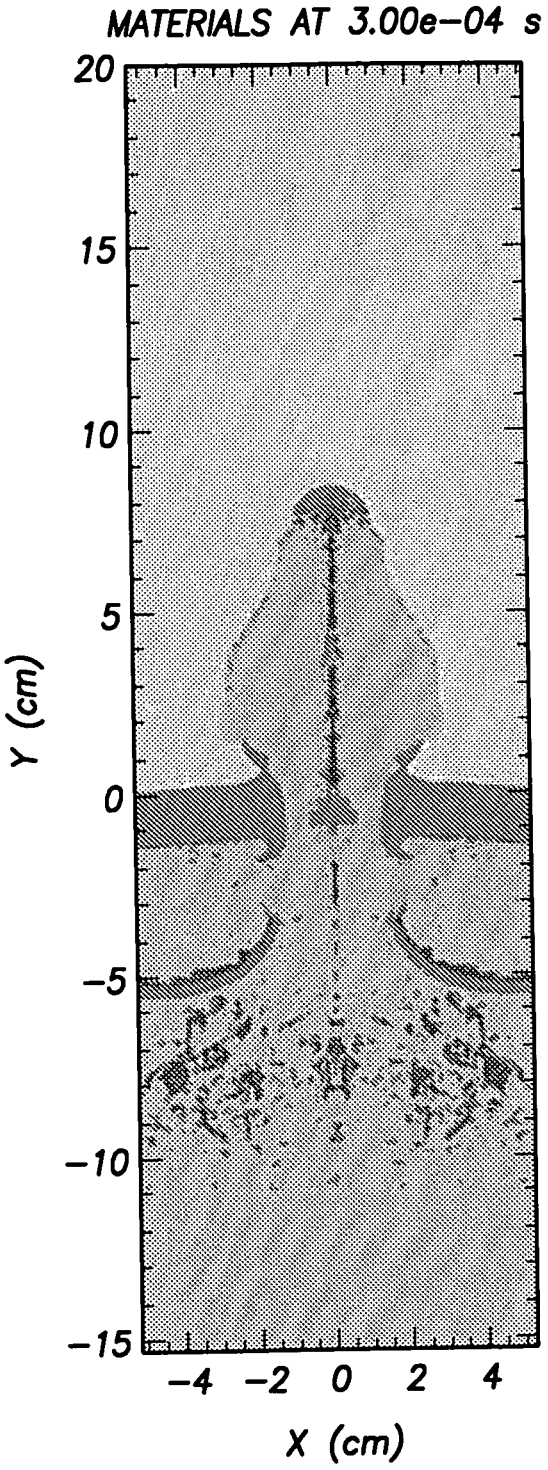
FIG. 9 illustrates modeling results of a perforation through a casing using a jet formed by an embodiment of an explosive charge assembly.

For the second charge case, a liner with a lip around the apex hole was modeled using the same models and parameters described with respect to Example 1. The results of the model are shown in FIG. 9. The results of the model illustrated in FIG. 9 demonstrate that the perforation in a casing is approximately 12% larger than the perforation created in the same casing by the baseline explosive charge assembly shown in FIG. 8. Accordingly, the explosive charge assembly comprising the lip illustrates an increased perforation size over comparable explosive charge assemblies without the lip.

Example 3

Figure 10:
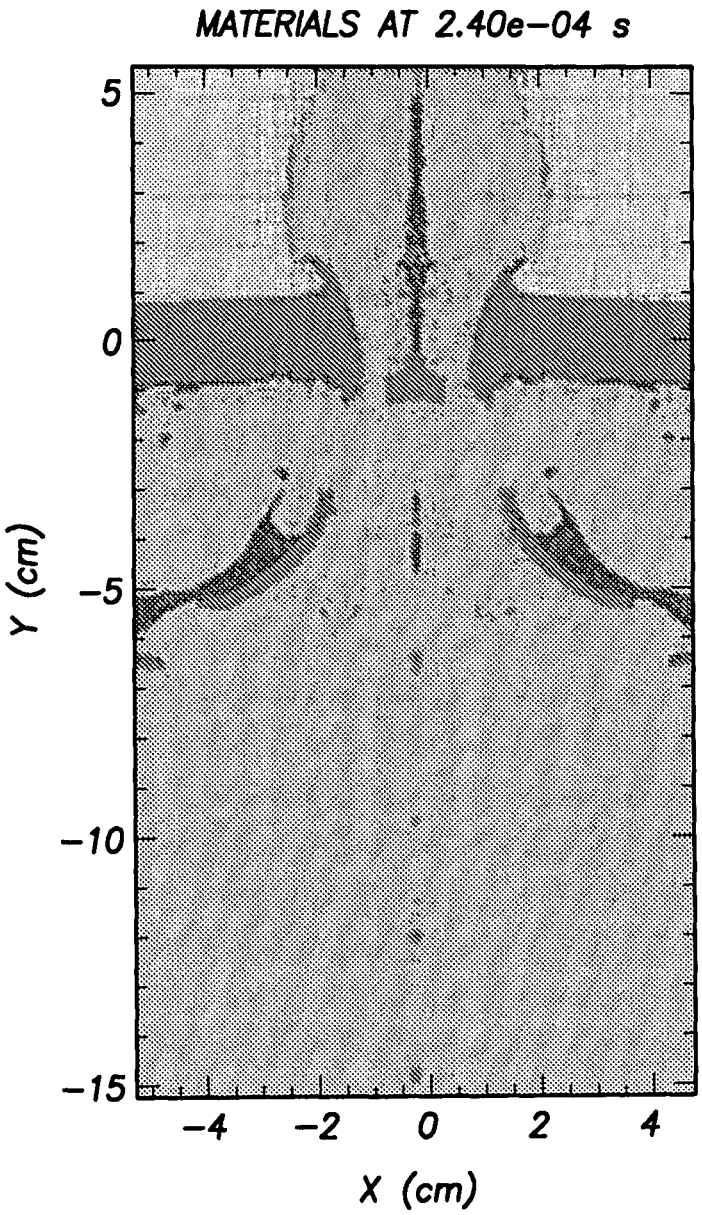
FIG. 10 illustrates modeling results of a perforation through a casing using a jet formed by another embodiment of an explosive charge assembly.

For the third charge case, another liner with a lip around the apex hole was modeled as a comparison with the results in Example 4. This case was modeled using the same models and parameters described with respect to Example 1. The results of the model are shown in FIG. 10.

Example 4

Figure 11:
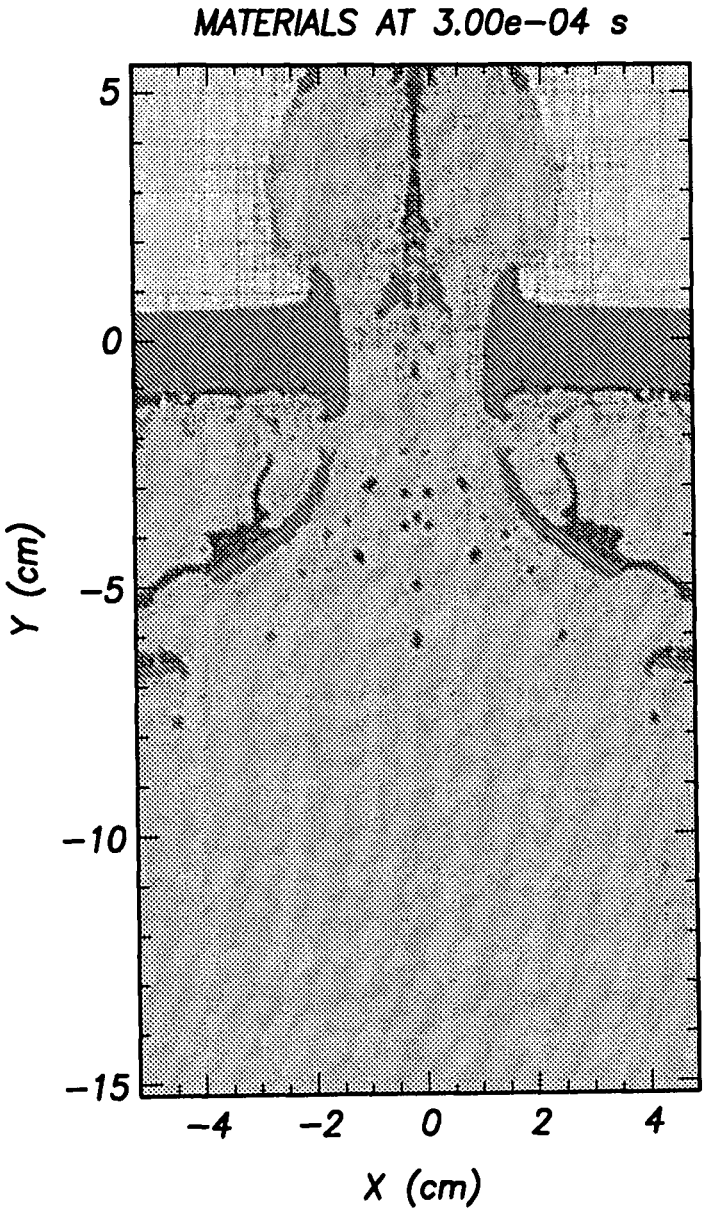
FIG. 11 illustrates modeling results of a perforation through a casing using a jet formed by still another embodiment of an explosive charge assembly.

For the fourth charge case, a liner with both a lip and an insert around the apex hole was modeled as a comparison with the results in Example 3. This case was modeled using the same models and parameters described with respect to Example 1. The insert modeled in this example was formed of copper. The results of the model illustrated in FIG. 11 demonstrate that the charge comprising both a lip and a liner creates a perforation in a casing which is 13% larger than a perforation created in the same casing by the explosive charge assembly having a lip alone as shown in FIG. 10. Accordingly, the explosive charge assembly comprising the lip and the insert illustrates an increased perforation size over comparable explosive charge assemblies comprising only the lip.

Example 5

Figure 12:
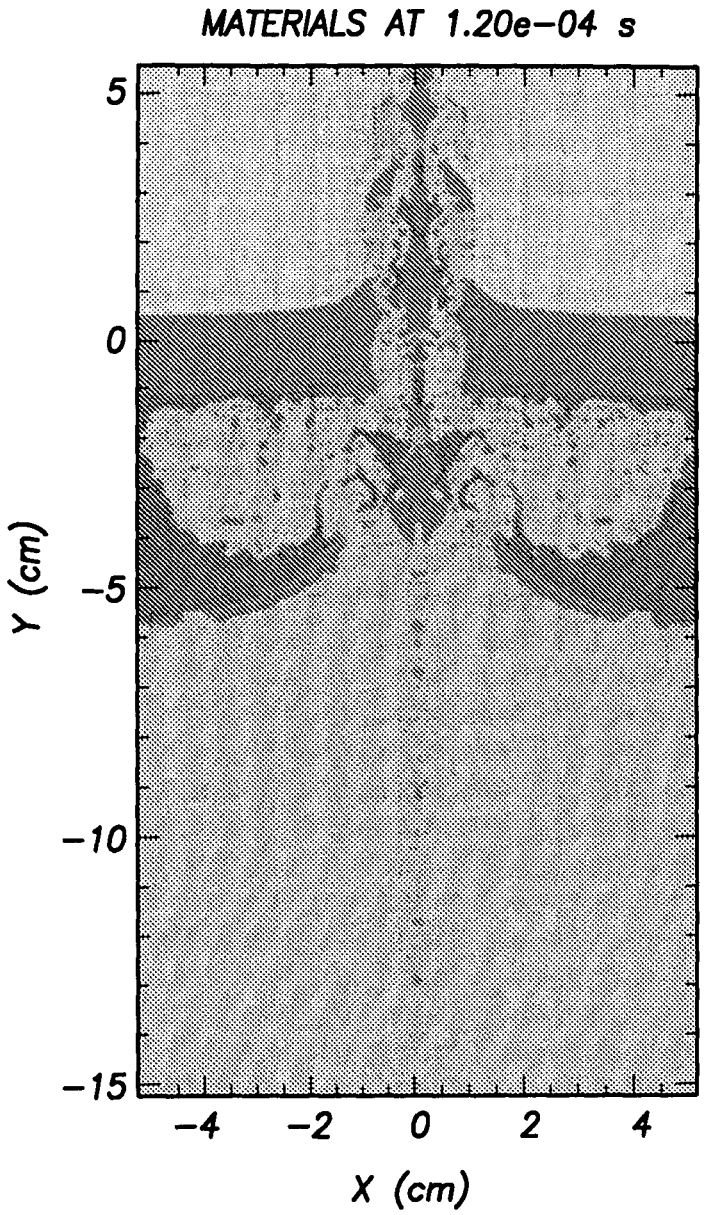
FIG. 12 illustrates modeling results of a perforation through a casing using a jet formed by an embodiment of an explosive charge assembly.

Additional modeling was performed to predict the effects of a copper insert relative to a convention liner with no insert or lip. In this example, a second base case with no insert or lip was modeled. The grid resolution used in CTH was 0.02 cm. The Mie-Gruneisen Equation of State (EOS) models inherent to CTH were used for the casing steel, shaped charge zinc case, shaped charge brass liner, and copper insert. A Jones-Wilkins-Lee (JWL) EOS model from CTH was used for the HMX explosive within the shaped charge. A SESAME EOS was used for the water. A Brittle Fracture Kinetics model was used as the Equation of State for the concrete target. The Von Mises strength models were used for the shaped charge zinc case. Johnson-Cook strength models were used for the shaped charge brass liner. A custom generated Zerilli-Armstrong model was used for the casing steel. The results of the model are shown in FIG. 12. The results provide a base, comparative case for comparison with the next example.

Example 6

Figure 13:
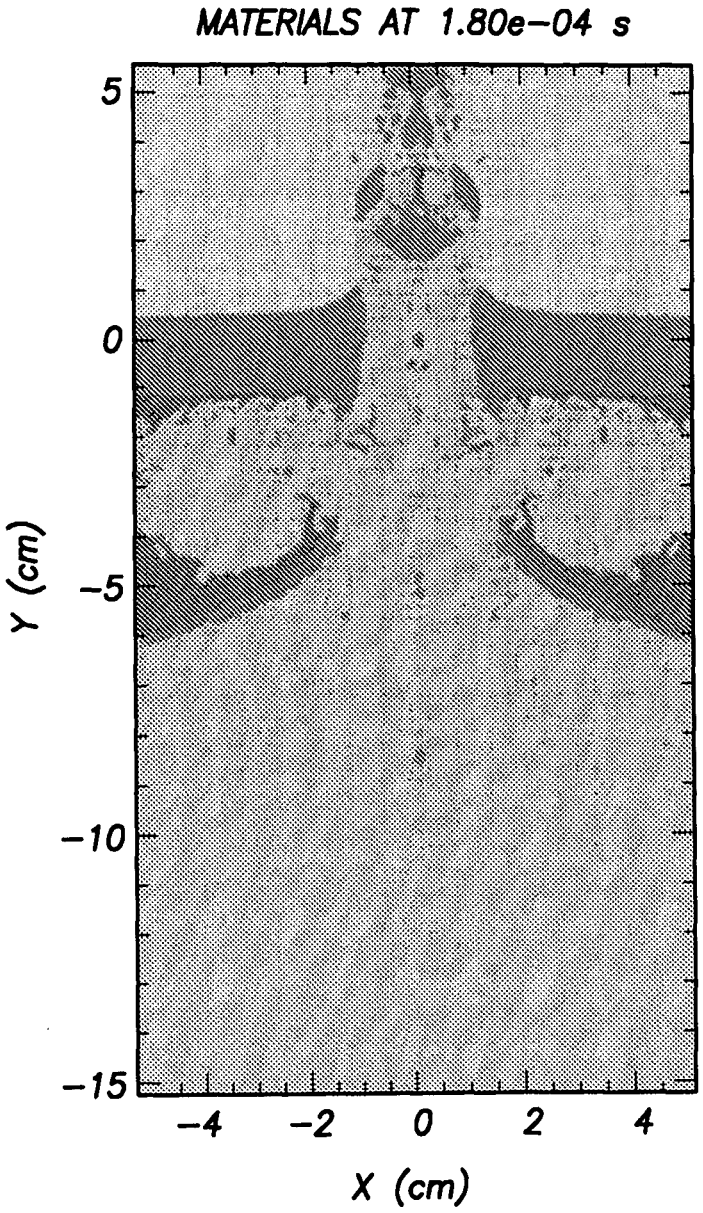
FIG. 13 illustrates modeling results of a perforation through a casing using a jet formed by another embodiment of an explosive charge assembly.

Additional modeling was performed to predict the effects of a copper insert without a lip. This example used the same models and parameters as those used in Example 5, where the Von Mises strength models was also used for the copper insert. The results of the model are shown in FIG. 13. The results of the model illustrated in FIG. 13 demonstrate that the charge comprising a copper insert as described herein creates a perforation in a casing which is 15% larger than a perforation created in the same casing by the explosive charge assembly having only a convention liner as shown in FIG. 12. Accordingly, the explosive charge assembly comprising the insert illustrates an increased perforation size over comparable explosive charge assemblies comprising only a liner (e.g., without a lip or insert).

Having described the various systems and method herein, various embodiments may include, but are not limited to:

In a first embodiment, an explosive charge assembly comprises a housing, a liner disposed on a face of an explosive charge, an opening through the liner disposed at the apex, and a lip disposed around the perimeter of the opening. The liner forms an apex and a mouth opposite the apex, and the liner and the explosive charge are disposed in the housing. The explosive charge is disposed between the liner and the housing, and the lip extends from the liner in a direction towards the mouth. In a second embodiment, the lip of the first embodiment may be a part of the liner. In a third embodiment, the assembly of the first or second embodiments may also include an insert disposed on the liner around the opening and adjacent to the lip. In a fourth embodiment, the insert of the third embodiment may be coupled to the liner and extend in a direction towards the mouth. In a fifth embodiment, the lip of the third or fourth embodiments may retain the insert in the housing. In a sixth embodiment, the insert of any of the third to fifth embodiments may extend from the lip a distance less than half the distance along the liner between the lip and the mouth. In a seventh embodiment, the lip of any of the first to sixth embodiments may extend away from the central axis of the assembly. In an eighth embodiment, the diameter of the opening of any of the first to seventh embodiments may be between about 0.1% and about 50% of the diameter of the mouth. In a ninth embodiment, the opening through the liner of nay of the first to eighth embodiments may be disposed about the central axis of the assembly.

In a tenth embodiment, a method of perforating comprises detonating an explosive charge assembly, forming a jet in response to the detonating, engaging a casing with the jet, and forming a perforation through the casing in response to the engagement with the jet. The explosive charge assembly comprises: a liner comprising an apex, a mouth opposite the apex, an opening at the apex, and an additional material coupled to the liner adjacent to the opening and extending in a direction towards the mouth. The additional material contributes to the formation of the jet. In an eleventh embodiment, the perforation of the tenth embodiment may have a diameter that is greater than a diameter of a comparative perforation formed from an explosive charge assembly without the additional material. In a twelfth embodiment, the diameter of the perforation of the eleventh embodiment may be greater than about 5% of a comparative perforation formed from an explosive charge assembly without the additional material. In a thirteenth embodiment, the additional material of any of the tenth to twelfth embodiments may comprise an insert. In a fourteenth embodiment, the perforation of the thirteenth embodiment may have a diameter that is great than a comparative perforation formed from an explosive charge assembly with a lip but without the insert. In a fifteenth embodiment, the diameter of the perforation of the fourteenth embodiment may not be less than 0.10% greater than a comparative perforation formed from an explosive charge assembly with the lip but without the insert. In a sixteenth embodiment, the additional material of any of the tenth to fifteenth embodiments comprises a lip.

In a seventeenth embodiment, a method for making a liner for an explosive charge assembly comprises drawing a material into a concave shape about a central axis of an apex, forming an opening through the material at the apex about the central axis, and providing additional mass around the perimeter of the opening. The apex is centered on the central axis, and a mouth is formed at the opposite end from the apex. The additional mass is coupled to the material and extends in a direction towards the mouth. In an eighteenth embodiment, the center of the material of the seventeenth embodiment may be drawn down to form the apex while the perimeter of the material forms a skirt portion terminating in a circular skirt edge at the mouth. In a nineteenth embodiment, the drawing, the forming of the opening, and the providing of additional mass around the perimeter of the opening of the seventeenth or eighteenth embodiments may each be a part of the same manufacturing process. In a twentieth embodiment, the drawing, the forming of the opening, and the providing of additional mass around the perimeter of the opening of any of the seventeenth to nineteenth embodiments may occur in a single stage. In a twenty first embodiment, forming an opening and providing additional mass around the perimeter of the opening of any of the seventeenth to nineteenth embodiments may occur in at least two stages. In a twenty second embodiment, the material of any of the seventeenth to twenty first embodiments may comprise a metal. In a twenty third embodiment, the material of any of the seventeenth to twenty second embodiments may be selected from the group of copper, copper alloy, aluminum, aluminum alloy, tin, tin alloy, lead, lead alloy, brass and tungsten. In a twenty fourth embodiment, the material of any of the seventeenth to twenty third embodiments may comprise copper. In a twenty fifth embodiment, providing additional mass around the perimeter of the opening of any of the seventeenth to twenty fourth embodiments may comprise forming a lip. In a twenty sixth embodiment, the lip of the twenty fifth embodiment may extend away from the central axis. In a twenty seventh embodiment, providing additional mass around the perimeter of the opening of any of the seventeenth to twenty sixth embodiments may comprise providing an insert. In a twenty eighth embodiment, the insert of the twenty seventh embodiment may extend along an interior surface of the material from the perimeter of the opening a distance of less than half a distance along the material between the perimeter of the opening and the mouth. In a twenty ninth embodiment, providing additional mass around the perimeter of the opening of any of the seventeenth to twenty sixth embodiments may comprise forming a lip and providing an insert. In a thirtieth embodiment, the lip of the twenty ninth embodiment may maintain the position of an insert disposed on the material around the opening and adjacent to the lip. In a thirty first embodiment, the diameter of the opening of any of the seventeenth to thirtieth embodiments may not be less than 0.1% of the diameter of the mouth and no greater than 50% of the diameter of the mouth.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed:

1. An explosive charge assembly comprising:

a housing;

an explosive charge disposed in the housing and comprising a face;

a liner disposed on the face of the explosive charge and in the housing such that the explosive charge is disposed between the liner and the housing, the liner comprising an apex, a mouth opposite the apex, an opening through the liner at the apex having a perimeter, and a lip disposed around the perimeter of the opening, and extending from the liner in a direction towards, and ending before a most forward plane formed by a ring of the mouth; and wherein propagation of the explosive charge is focused along an explosive focus axis extending from the opening.

2. The assembly of claim 1, further comprising an insert disposed on the liner around the opening and adjacent to the lip.

3. The assembly of claim 2, wherein the insert is coupled to the liner and extends in a direction towards the mouth.

4. The assembly of claim 2, wherein the lip retains the insert in the housing.

5. The assembly of claim 2, wherein the insert extends from the lip a distance less than half the distance along the liner between the lip and the mouth.

6. The assembly of claim 1, wherein the lip extends away from the central axis of the assembly.

7. The assembly of claim 1, wherein the diameter of the opening is between 0.1% and 50% of the diameter of the mouth.

8. The assembly of claim 1, wherein the opening through the liner is disposed about the central axis of the assembly.

9. A method of perforating comprising:

detonating an explosive charge assembly, wherein the explosive charge assembly comprises:

a liner disposed on a face of an explosive charge, wherein the liner comprises an apex, a mouth opposite the apex, an opening through the liner at the apex having a perimeter, and a lip disposed around the perimeter of the opening and extending from the liner in a direction towards, and ending before a most forward plane formed by a ring of the mouth;

forming a jet focused along an explosive focus axis extending from the opening in response to the detonating, wherein the lip contributes to the formation of the jet;

engaging a casing with the jet; and forming a perforation through the casing in response to the engagement with the jet.

10. The method of claim 9, wherein the perforation has a diameter that is greater than a diameter of a comparative perforation formed from an explosive charge assembly without the lip.

11. The method of claim 10, wherein the diameter of the perforation is greater than 5% of a comparative perforation formed from an explosive charge assembly without the lip.

12. The method of claim 9, comprising an insert disposed on the liner around the opening and adjacent to the lip.

13. The method of claim 12, wherein the perforation has a diameter that is greater than a comparative perforation formed from an explosive charge assembly with the lip but without the insert.

14. The method of claim 13, wherein the diameter of the perforation is no less than 0.10% greater than a comparative perforation formed from an explosive charge assembly with the lip but without the insert.

15. The method of claim 12, wherein the lip retains the insert.

16. A method for making a liner for an explosive charge assembly, the method comprising:

drawing a material into a concave shape about a central axis of an apex, wherein the apex is centered on the central axis, wherein a mouth is formed at the opposite end from the apex;

forming an opening through the material at the apex about the central axis; and forming a lip in the material around a perimeter of the opening, wherein the lip extends from the material in a direction towards, and ending before a most forward plane formed by a ring of the mouth, and wherein propagation of an explosive charge is focused along the central axis.

17. The method of claim 16, wherein the drawing, the forming of the opening, and the forming a lip around the perimeter of the opening are each a part of the same manufacturing process.

18. The method of claim 16, wherein the material comprises a metal.

19. The method of claim 16, wherein the material is selected from the group of copper, copper alloy, aluminum, aluminum alloy, tin, tin alloy, lead, lead alloy, brass and tungsten.

20. The method of claim 19, wherein the material comprises copper.

21. The method of claim 16, wherein the lip extends away from the central axis.

22. The method of claim 16, comprising providing an insert disposed on the material around the opening and adjacent to the lip.

23. The method of claim 22, wherein the insert extends along an interior surface of the material from the perimeter of the opening a distance of less than half a distance along the material between the perimeter of the opening and the mouth.

24. The method of claim 22, wherein the lip maintains a position of the insert.

25. The method of claim 16, wherein a diameter of the opening is no less than 0.1% of the diameter of the mouth and no greater than 50% of the diameter of the mouth.

* * * * *